US006407309B1

(12) United States Patent
Schilkowski

(10) Patent No.: US 6,407,309 B1
(45) Date of Patent: Jun. 18, 2002

(54) ABSORBENT SHEET OR WEB MATERIAL AND A METHOD OF PRODUCING THE MATERIAL BY DRY FORMING

(75) Inventor: Helmut Erwin Schilkowski, Malling (DK)

(73) Assignee: Scan-Web I/S, Risskov (DK)

( * ) Notice: Subject to any disclaimer, the term of this patent is extended or adjusted under 35 U.S.C. 154(b) by 0 days.

(21) Appl. No.: 09/125,143

(22) PCT Filed: Feb. 12, 1997

(86) PCT No.: PCT/DK97/00066

§ 371 (c)(1),
(2), (4) Date: Aug. 11, 1998

(87) PCT Pub. No.: WO97/30223

PCT Pub. Date: Aug. 21, 1997

(30) Foreign Application Priority Data

Feb. 12, 1996 (DK) ..... 0144/96

(51) Int. Cl.[7] ..... A61F 15/13

(52) U.S. Cl. ..... 604/365; 604/366; 604/378; 442/409; 442/411; 442/413; 442/416; 428/298.1; 428/299.7; 428/300.4; 428/311.71

(58) Field of Search ..... 442/409, 411, 442/413, 416, 39; 604/366, 365, 378; 428/137.1, 298.1, 299.7, 300.4, 311.71

(56) References Cited

U.S. PATENT DOCUMENTS

| | | | | | |
|---|---|---|---|---|---|
| 3,886,942 | A | | 6/1975 | Bernardin | |
| 4,054,141 | A | | 10/1977 | Schwaiger | |
| 4,292,271 | A | * | 9/1981 | Buob et al. | 264/518 |
| 4,385,954 | A | * | 5/1983 | Pauls et al. | 156/244.21 |
| 4,494,278 | A | * | 1/1985 | Kroyer et al. | 19/304 |
| 4,731,277 | A | | 3/1988 | Groitzsch | |
| 5,171,238 | A | * | 12/1992 | Kajander | 604/383 |
| 5,266,250 | A | * | 11/1993 | Kroyer | 264/45.3 |
| 5,718,699 | A | * | 2/1998 | Brisebois | 604/385.1 |
| 5,723,209 | A | * | 3/1998 | Borger et al. | 428/219 |
| H1724 | H | * | 4/1998 | Ahr | 604/385.1 |
| 5,820,616 | A | * | 10/1998 | Horney | 604/378 |
| 5,855,572 | A | * | 1/1999 | Schmidt | 604/378 |
| 5,895,379 | A | * | 4/1999 | Litchholt et al. | 604/378 |
| 5,916,670 | A | * | 6/1999 | Tan et al. | 428/219 |

FOREIGN PATENT DOCUMENTS

| | | |
|---|---|---|
| EP | 0678608 | 10/1995 |
| WO | 9518886 | 7/1995 |

* cited by examiner

*Primary Examiner*—John G. Weiss
*Assistant Examiner*—Michael Bogart
(74) *Attorney, Agent, or Firm*—Browdy and Neimark, P.L.L.C.

(57) ABSTRACT

An inexpensive sheet or web shaped fibre material for use e.g., in sanitary napkins typically consists of a mixture of short cellulose fibres and some 15% of relatively long, thermoplastic binder fibers. It is a noticeable problem that the short fibres "dust" out of the material, and according to the invention this is remedied in that the material, when made by dry forming, is provided with a surface coating of very thin layers of pure binder fibres. In addition to a marked holding back of the dust, these layers condition that the amount of binder fibres in the base material can be halved and that the breaking stress of the material is noticeably improved. Thereby the products are usable not only as inserts, but also as individual, self-contained units e.g., for wiping in domestic or industrial cleaning.

10 Claims, 1 Drawing Sheet

Figure 1:
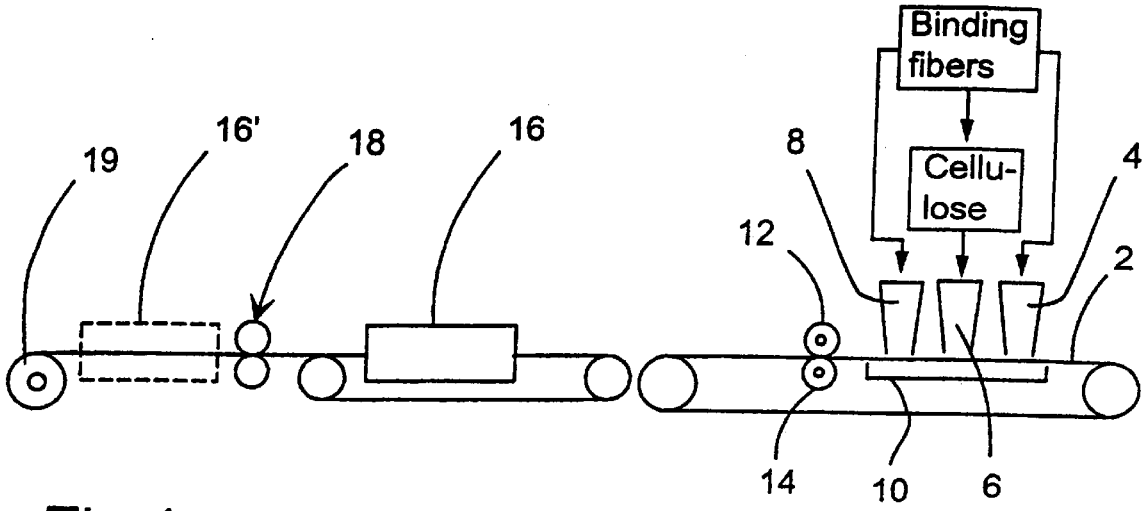

ABSORBENT SHEET OR WEB MATERIAL AND A METHOD OF PRODUCING THE MATERIAL BY DRY FORMING

The present invention relates to a method of producing an absorbent sheet or web material by the dry forming of a layer of short cellulose fibres in admixture with relatively long, thermoplastic binding fibres which are actuated by heating. Products of this type are typically used as absorbent inserts in sanitary articles, e,g. in sanitary napkins for women, With respect to both production price and absorption capacity it is desirable to use a relatively low degree of admixture of the binding fibres, normally some 15%, but in return the problem arises that the products "dust" with the short fibres, which may amount to a serious problem, in particular in relevant further processing operations. In principle, it is possible to avoid the dusting by applying a bonding substance onto the product surfaces, but this will complicate the manufacturing and make the products more expensive.

With the invention it has surprisingly been found that it is possible to achieve an inexpensably obtained surface sealing which will effectively prevent any noticeable dusting from the products. To this end, the production is arranged such that a laminated product is built up, comprising a first, very thin layer of pure binding fibres, e.g. with an amount of only some 3 g/m$^2$ and thus with a rather open structure conditioning a good penetration of liquid, a following layer of a fibre mixture of short cellulose fibres and longer binding fibres, though preferably with a reduced content of binding fibres, e.g. with a ratio of 93:7 or 95:5 of cellulose and binding fibres, respectively, and a final top layer corresponding to the thin layer of binding fibres as first laid out. The product thus shaped is passed through a heating zone for actuation of the binding fibres generally in the entire laminated product.

The low content of binding fibres in the middle layer may result in a delamination in small areas of the product in response to folding. This can be avoided by calandering the product in a heated calander such that top and bottom layers of the product are welded together, though only over 5–20% of the surface, preferably about 10%.

With an amount of binding fibres of only 1–5 g/m$^2$ in the outer layers, preferably 2–4 g/m$^2$, it is easily understood that these layers will be readily liquid permeable, as the open surface area will amount to 80–90%. On the other hand, it is partly inexplainable how the same limited fibre coating can effect a marked reduction or almost total elimination of the dusting of short fibres from the products. However, both laboratory tests and test productions have verified that this effect with respect to dust binding is indeed achieved.

In connection with the invention it has been found, surprisingly, that the very thin surface layers' provide for a marked increase of the tensile strength of the products, by as much as 3–4 times, and that the surface wear strength of the material is also considerably increased. From a quality point of view the material is hereby upgraded from an absorbent insert material, which requires a surface protecting layer, to a self contained product that is usable e.g. for cleaning purposes domestically and in the industry, while still having a low content of binding fibres of only some 15% or less.

From U.S. Pat. No. 4,054,141 it is known to produce relatively thick pad members with a core layer of absorption fibres and with surface layers consisting of a mixture of these fibres and binding fibres. The surface layers are in no way "thin" layers with binding fibres oriented mainly in the plane of the surface, as to the contrary it is emphasized that a large part of the fibres project inwardly in or from the surface so as to enable an easier penetration of liquid and a certain cohesion in the outer layer. Thus, the the relatively thick core layer is not internally bonded, whereby it will easily delaminate, and for the formation of the surface layers it will be necessary to use a considerable amount of binding fibres, which will only partially be active as a coherent, liquid permeable surface, It is well thinkable that in some way, not further specified, it is possible to achieve a certain surface barrier effect against extrusion of the non-bonded, short fibres in the core layer, but then only with a rather large concentration of binding fibres in a surface layer of noticeable thickness.

Moreover, the relatively large amount of binding fibres with this known method will, not result in the said surprising increase of product strength, inasfar as this increase has to be connected with the fact that the binding fibres are present in a thin layer with the fibres oriented in the surface plane itself; fibres projecting inwardly from the surface cannot contribute to a strength increase and not either to a e barring against extruding short fibre dust, which is an established problem in connection with aftertreatment of the is products.

The method known from the said U.S. Pat. No. 4,054,141 is based on a cell filling of special moulds for forming shaped, limited pad mambers, while the present invention is based on a production of a relatively thin web material which can be manufactured with much higher capacity and can be folded or pleaded. into a plural layer shape and then be cut to form pad members consisting of tore layers. The web or sheet material, of course, also finds many other possibilities of application.

Figure 2:
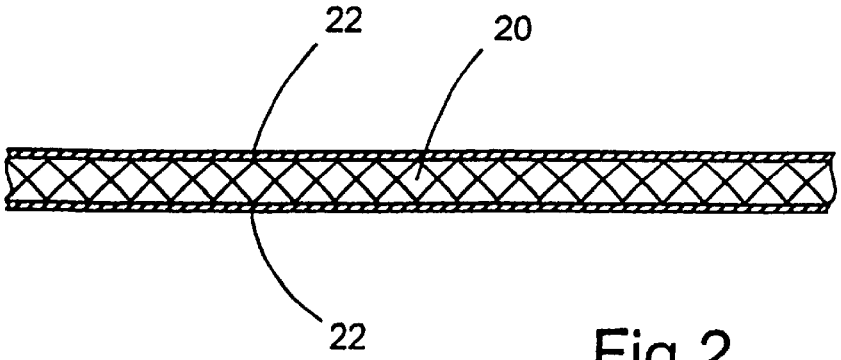

In the following the invention is described in more detail with reference to the drawing, in which:

FIG. 1 is a schematic view of a system for producing products according to the invention, while FIG. 2 is a sectional view of a web produced thereby.

FIG. 1 shows a dry forming system with a perforated forming wire 2, above which there is provided three consecutive forming heads 4, 6 and 8 for distribution of supplied fibres across the wire 2, Beneath the wire, fully conventionally, there is mounted a suction box 10 to which air is sucked down through the wire, partly for a rapid deposition of the fibres on the wire and partly for stabilizing the formed fiber layer or layers thereon.

It is well known that with such an arrangement with more forming heads it is possible to produce laminated products, and with the invention this principle is used to the effect that there is supplied to the first and the last forming head a weak flow of air fluidized, relatively long binding fibres for the formation of outer product layers with very small thickness and density, e.g. only 2–3 g/m$^2$, while the intermediate forming head is used for the formation of the basic fiber web. This web may be made with desired properties, thickness and density out of a mixture of cellulose fibres and binding fibres, preferably with a binding fibre content of only 2–4%.

For stabilizing the very thin outer layers on the produced web, the web together with the wire is passed through a pair of rollers 12,14, which are preferably heated for achieving a slight compaction of the product, whereby it is consolidated sufficiently for a following conveying to a flow-through oven 16, in which the binding fibres are activated.

From the oven 16 the web, now stabilized, is moved through a calander unit 18, the rollers of which are kept heated to a temperature a few degrees below the actuation temperature of the binding fibres. Thereafter the web is finally reeled up at 19.

In connection with the calandering the web may be subjected to a point or line embossing for additional stabilization of the thin outer layers of coker fibers and for counteracting a delamination of the products.

As shown in FIG. 2 the web product. will consist of an absorbent middle layer 20 of a desired thickness with surface layers 22 of binding fibers and of very small thickness. As mentioned, it has been found as a surprising fact that these surface layers even for an opening degree of 80–90% act retaining on the short cellulose fibers as present in unbonded condition in the middle layer. It is undoubtedly contributory to this effect that the surface layers are provided as separatly laid out, thin layers, in which the binding fibres will predominantly be oriented in the layer plane itself, while the same fibres in the middle layer occur with random orientations so as to have no special barrier effect towards the loose short fibres.

It is also the pronounced layer orientation of the cover fibres that will condition the said marked increase of strength, because of the strong mutual binding of the fibres.

In this connection it is important that the binding fibre layers are as "clean" as possible, because the presence of even a small amount of cellulose fibres would weaken the binding in the layers noticeably.

It is not required to use precisely the same type of binding fibres in the middle layer and the surface layers, respectively, and it can even be considered to optimize the surface fibres without heavy economical consequences, because they are used in very small amounts only.

For certain products, ergo for further monolateral lamination, it may be sufficient to use a surface layer 22 at one side only.

It should be mentioned that it has been found by experiments that a layer thickness of 7–10 g/m$^2$ in the surface layers of the heat actuated binder fibres results in an unacceptable reduction of the absorption capacity and the opacity.

In a product of 75 g/m$^2$ the total content of binding fibres will then be some 30%, rendering the product perceivably "synthetic" and unrealistically expensive.

It has been found that it is possible to obtain a further and quite noticeable increase of the tensile strength by moving the web material, after the calandering at the rollers 18, through a heating zone as shown in dotted lines at 16', such that a renewed actuation of the binding fibres can be effected. This also results in an improved barrier effect against dusting from the material as well as an improvement of the retention capacity, i.e. the ability to retain rest liquid after squeezing of wet material.

The discussed properties will now be illustrated by two examples;

EXAMPLE 1

With the use of 14.4% Al-Special-C Phil 65/35 1,7×6

(heat actuated binding fibres, Danaklon A/S, Denmark and 85, 6% NF 405 (Softwood pulp, wood cellulose, Wyerhaeuser, USA)

two different products are made by dry forming:

A: With homogenous fibre mixture and conventional heat actuation of binding fibres.

B1: With bottom and top surface layer 3 g/m$^2$ 100% binding fibres and a middle layer of a homogenous mixture of cellulose and binding fibres in the ratio 93:7.

B2: B1 after calandering.

B3: B2 after passage of heat tunnel 142° C.

Relevant measuring results:

| | Weight g/m$^2$ | Thickness mm | Density kg/m$^3$ | Breaking strength MD, g/2" | Dust mg | Waterabsorption g/g | Retention g/g |
|---|---|---|---|---|---|---|---|
| A: | 76 | 1,20 | 63 | 315 | 90 | 15 | 4,9 |
| B1: | 74 | 1,10 | 67 | 750 | 18 | 14 | 5,0 |
| B2: | 73 | 0,60 | 122 | 1770 | 1,0 | 6,4 | 4,5 |
| B3: | 72 | 0,63 | 114 | 2010 | 0,6 | 6,7 | 5,3 |

The listed values should serve primarily for mutual comparison, so it is deemed superfluous to describe the measuring methods in more detail.

EXAMPLE 2

In the same manner, products A, B1 and B2 are produced based on 15, 6% Al-Special-C Phil 65/35 1,7×6 binding fibres and 84, 4% Rayfloc-X-J (Softwood pulp, wood cellulose; ITT Rayonier Inc., USA)

| | Weight g/m$^2$ | Thickness mm | Density kg/m$^3$ | Breaking strength MD, g/2" | Dust mg | Waterabsorption g/g | Retention g/g |
|---|---|---|---|---|---|---|---|
| A: | 101 | 1,22 | 83 | 785 | 61 | 14 | 6,1 |
| B1: | 97 | 1,08 | 90 | 1020 | 19 | 13 | 5,0 |
| B2: | 102 | 0,76 | 134 | 2100 | 1,6 | 5,4 | 4,8 |

What is claimed is:

1. A method of dry forming a sheet or web material of absorbent type comprising a dry formed product of short cellulose fibres and relatively long, thermoplastic binding fibres, typically for use as inserts in sanitary articles, the material having a surface layer with binding fibres, characterized in that the web material comprises a core or main layer of cellulose fibers in admixture with a small amount of binding fibres and, at one or both sides, a very thin surface layer solely consisting of binding fibres and with said fibres predominantly oriented in the surface plane itself, whereby in said method a mixture of short cellulose fibres and relatively long thermoplastic binding fibres is laid out on a forming wire from a forming head, whereafter the binding fibres are actuated by the web passing through a heat zone, characterized in that a very thin layer of binding fibres is laid out from a separate forming head before or after the laying out of the said fibre mixture so as to form a very thin surface layer on the top or bottom side of the web, wherein a corresponding thin binding fibre layer is laid out from an additional forming head, for coating an opposite side of the web.

2. A method according to claim 1, characterized in that the mono or preferably double sided coated web is subjected to a calandering after its passage through the heating zone.

3. A method according to claim 2, characterized in that the web is additionally moved through a heating zone after the calandering.

4. A method according to claim 1, characterized in that the mixed fibre layer is used with a content of only 2–10% of binding fibres.

5. A method according to claim 4 wherein the mixed fiber layer has a content of 5–8% of binding fibers.

6. A method according to claim 1, characterized in that from an additional forming head a corresponding thin binding fibre layer is laid out for coating an opposite side of the web.

7. A method according to claim 6, characterized in that for the calandering there is used a heated calander providing a welding together of the two surface layers over 5–20% of the web area.

8. A method according to claim 6 wherein said welding together of the two surface layers is over approximately 10% of the web area.

9. An absorbent sheet or web material comprising a central layer of cellulose fibers in admixture with a small amount of binding fibers, said central layer having two surfaces, one said surface being on each side of said central layer, and a surface layer bonded to each surface of said central layer, each said surface layer consisting essentially of binder fibers orientated substantially parallel to said surface layers and present in an amount of less than 7 $g/m^2$ and defining an open structure, said surface layers being welded to said central layer through only about 5–20% of the surface area of said central layer.

10. An absorbent material according to claim 9 wherein said central layer contains no greater than about 15% of binding fibers having random orientation.

* * * * *